US005880663A

United States Patent [19]

Leonelli

[11] Patent Number: 5,880,663

[45] Date of Patent: Mar. 9, 1999

[54] BRIDGE SWITCH

[76] Inventor: Fred Leonelli, 4110 Brookview Dr., Atlanta, Ga. 30339-4647

[21] Appl. No.: 821,287

[22] Filed: Mar. 20, 1997

Related U.S. Application Data

[60] Provisional application No. 60/013,988 Mar. 22, 1996.

[51] Int. Cl.[6] ..... H01H 71/20; H01J 7/44

[52] U.S. Cl. ..... 337/145; 337/150; 315/68; 315/69

[58] Field of Search ..... 337/142, 143, 337/144, 145, 146–158; 315/65–70, 89, 90, 119, 192, 224

[56] References Cited

U.S. PATENT DOCUMENTS 4,447,760 5/1984 Koo ..... 315/65

*Primary Examiner*—Leo P. Picard
*Assistant Examiner*—Anatoly Vortman
*Attorney, Agent, or Firm*—Thomas, Kayden, Horstemeyer & Risley

[57] ABSTRACT

A bridge switch consists of a fusible link between two balanced electrical loads connected in parallel. This fusible link stops a movable member from completing a secondary circuit. When that fusible link is destroyed the movable member is allowed to close the electrical contact(s) that will cause power to go to a secondary circuit. When one side of the parallel circuit to which the bridge switch is connected fails causing current to flow through the fusible link at a rate high enough to destroy that link allowing the movable member to activate the secondary circuit and/ or removing power from the primary circuit. More than one bridge switch may be employed in the total circuit where the second bridge switch is connected across two elements of the secondary circuit with the movable member restoring power to the primary parallel circuit without removing it from the secondary parallel circuit. This would then create a third parallel circuit. In addition the movable member may have numbers or colors on it that can be seen through a clear area this would give maintenance people the status of the switch. Additional electrical contacts for notification circuits may be incorporated into the body of the switch in some applications.

2 Claims, 8 Drawing Sheets

BRIDGE SWITCH

CROSS-REFERENCE TO RELATED APPLICATION

This application claims the benefit of U.S. Provisional patent application Ser. No. 60/013,988, filed Mar. 22, 1996.

FIELD OF THE INVENTION

This invention generally relates to a circuit for switching between two devices and, more particularly, a circuit for switching from a first device to a second device upon failure of the first device.

SUMMARY OF THE INVENTION

The present invention, in general, is a switching circuit for switching in a back-up load or device when a primary load or device fails. The invention is described with reference to the switching of filaments within a lamp, such as a head lamp or a traffic light. The invention, however, is not limited to the switching of filaments and may be applied to any type of load. In general, the loads are connected in parallel and the circuit switches from a primary load to a back-up load upon failure of the primary load.

The switching may be executed in one of several different ways. For instance, the switching may occur after a change in current through a relay or, preferably, after a fusible link has blown. The fusible link, in some embodiments, permits a leaf spring to switch the application of power from the primary filaments to the back-up filaments after the link is blown. In other embodiments, the fusible link permits the movement of a contact terminal or terminals from the primary filament to the back-up filaments upon failure of the link. In yet other embodiments, the fusible link prevents the motion of a moveable contact until a current surge blows the fusible link. The fusible links may be staggered so as to provide more than one back-up filament or load.

The invention provides an improved safety circuit which prolongs the life of a lamp, such as a automobile head lamp or traffic light, after one set of filaments become burned out. The invention also decreases the cost of having the lamps replaced. While in some situations the cost of the lamp may not be significant, the cost of having a work crew access the lamp and, perhaps reroute traffic, is quite substantial. Since the invention prolongs the life of the lamps, the invention would also reduce costs required to maintain the lamps in operation.

The principles and features of the present invention will be more readily apparent and understood from the following detailed description, read in conjunction with the accompanying drawings.

PRIOR ART

| Ref. cited U.S. Patents | | | |
|---|---|---|---|
| 3,673,534 | 6/1972 | Marinace | 315/64 |
| 3,886,400 | 5/1975 | Dill | 315/64 |
| 3,983,447 | 9/1976 | Mark ET AL | 315/64 |
| 4,179,637 | 12/1979 | Santora | 315/64 |
| 4,287,452 | 9/1981 | Fernandez III | 315/65 |
| 4,382,209 | 5/1983 | Loucaides | 315/65 |
| 4,447,760 | 5/1984 | Koo | 315/65 |
| 4,841,196 | 6/1989 | Waymouth | 315/65 |

BRIEF DESCRIPTION OF THE DRAWINGS

The present invention can be better understood with reference to the following drawings. Note that like reference numerals designate corresponding parts throughout the several views.

DETAILED DESCRIPTION

Figure 1:
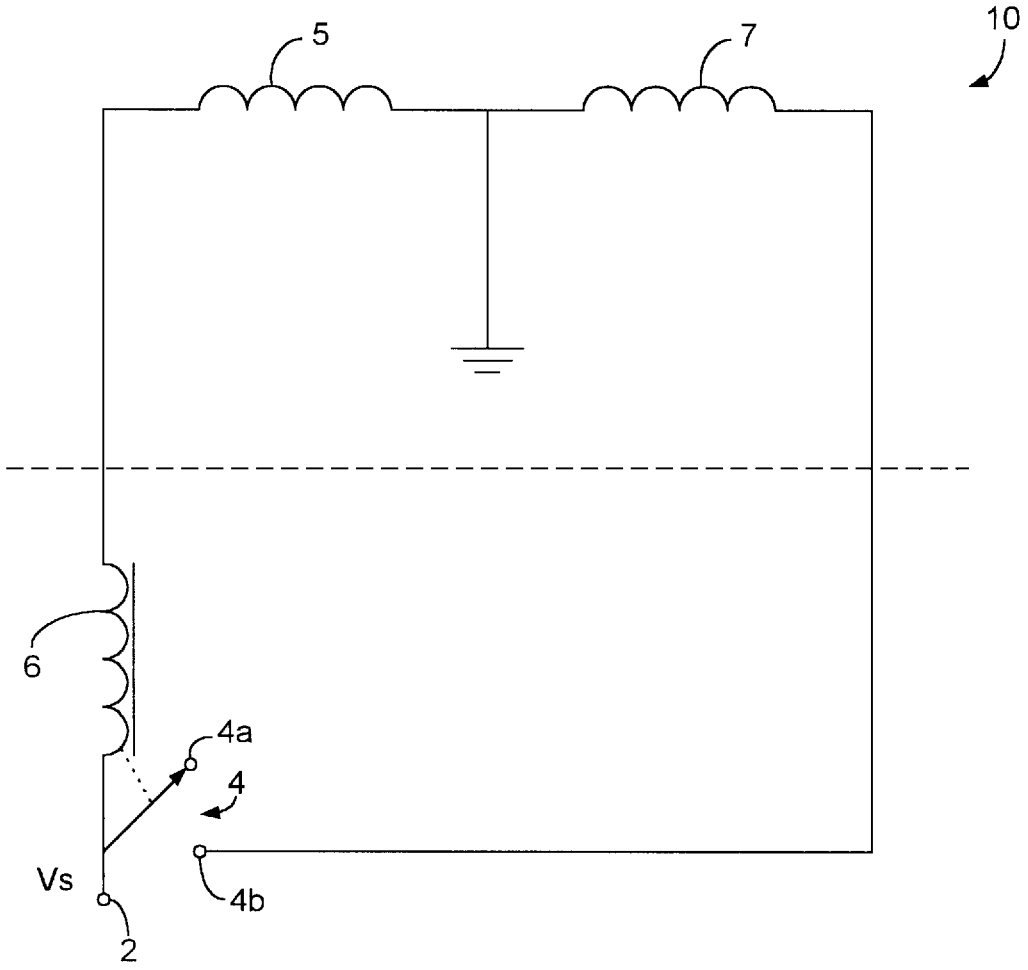
FIG. 1 is a schematic diagram of a switching circuit according to a first embodiment of the invention.

With reference to FIG. 1, a circuit 10 switches between two devices 5 and 7. The circuit 10 comprises two filaments 5 and 7 for use in a light bulb, such as in an automobile headlight. It should be understood, however, that the invention may be applied to other types of light bulbs, such as traffic lights or residential indoor lights, as well as in other types of circuits. The circuit 10 also comprises a relay having a coil 6 and a switching element 4. The switching element 4 of the relay is normally in position 4*a* when current flows through the coil 6 of the relay and is at position 4*b* when current no longer flows through the coil 6 of the relay.

In operation, a voltage source $V_s$ is applied to a power terminal 2, thereby causing a current to flow through the coil 6 of the relay and also through filament 5. A ground terminal is connected between the two filaments 5 and 7, whereby only filament 5 is illuminated. Due to the current flowing through the coil 6 of the relay, the switching element 4 is placed at the open circuit position 4*a*. When the filament 5 burns out, current ceases to flow through the coil 6 of the relay, and the switching element 4 is thrown to position 4*b*. Consequently, the voltage $V_s$ is subsequently applied to filament 7 and a current flows through filament 7 to ground. Thus, the circuit 10 automatically switches in a backup filament 7 upon failure of the first filament 5. The circuit 10 is therefore ideal for automobile lights or traffic lights which, for safety reasons, should always be operable.

The circuit 10 may be fabricated in any suitable manner. For instance, the filaments 5 and 7 may form the bulb element of the light and the relay portion of the circuit may be formed separately. Further, the relay portion of the circuit 10 may be formed so that it screws into the base of an existing lamp receptacle and is able to receive the bulb portion having the filaments 5 and 7. In this manner, existing lamp receptacles may receive the advantages of a dual filament bulb, such as that in circuit 10.

Figure 2:
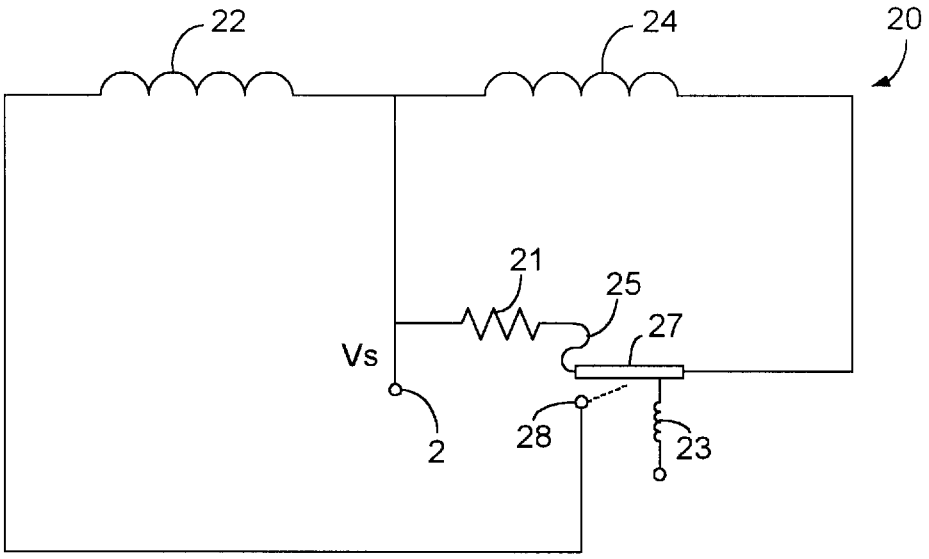
FIG. 2 is a schematic diagram of a switching circuit according to a second embodiment of the invention.

A circuit 20, according to a second embodiment of the invention, as shown in FIG. 2, comprises two filaments 22 and 24. A voltage source $V_s$ is applied to a power terminal 2 whereby current normally flows through filament 24 to ground, thereby illuminating the lamp. The voltage source $V_s$ is also applied to one terminal of filament 22 but, since the other terminal of filament 22 is floating, no current flows through the filament 22. When the filament 24 burns out, current no longer flows through the filament 24 and instead flows through a resistor 21, a fusible link 25, and through a conductive leaf spring 27 to ground. The value of resistor 21 is large in comparison to the resistive value of filament 24 whereby only a small amount of current flows from power terminal 2 to ground through the resistor 21, fusible link 25, and leaf spring 27. When the fusible link 25 burns out, however, a current surge goes through the resistor 21 and burns out the fusible link 25 thereby forming an open circuit. A coil spring 23 biases the leaf spring 27 toward a terminal 28 but, due to the connection to the fusible link 25, is normally maintained in the position shown in the figure. Upon burning out of the fusible link 25, however, the leaf spring 27 becomes detached from the resistor 21 and is allowed to travel to terminal 28. The coil spring 23 assists the leaf spring 27 in its travel toward the terminal 28 and also maintains the leaf spring 27 in firm contact with terminal 28, even with movement of the circuit 20. Thus, if the filaments 22 and 24 are placed within an automobile head lamp, the coil spring 23 will maintain continuous electrical contact between the leaf spring 27 and terminal 28 after burnout of filament 24, even if the automobile encounters a bumpy road.

Figure 3:
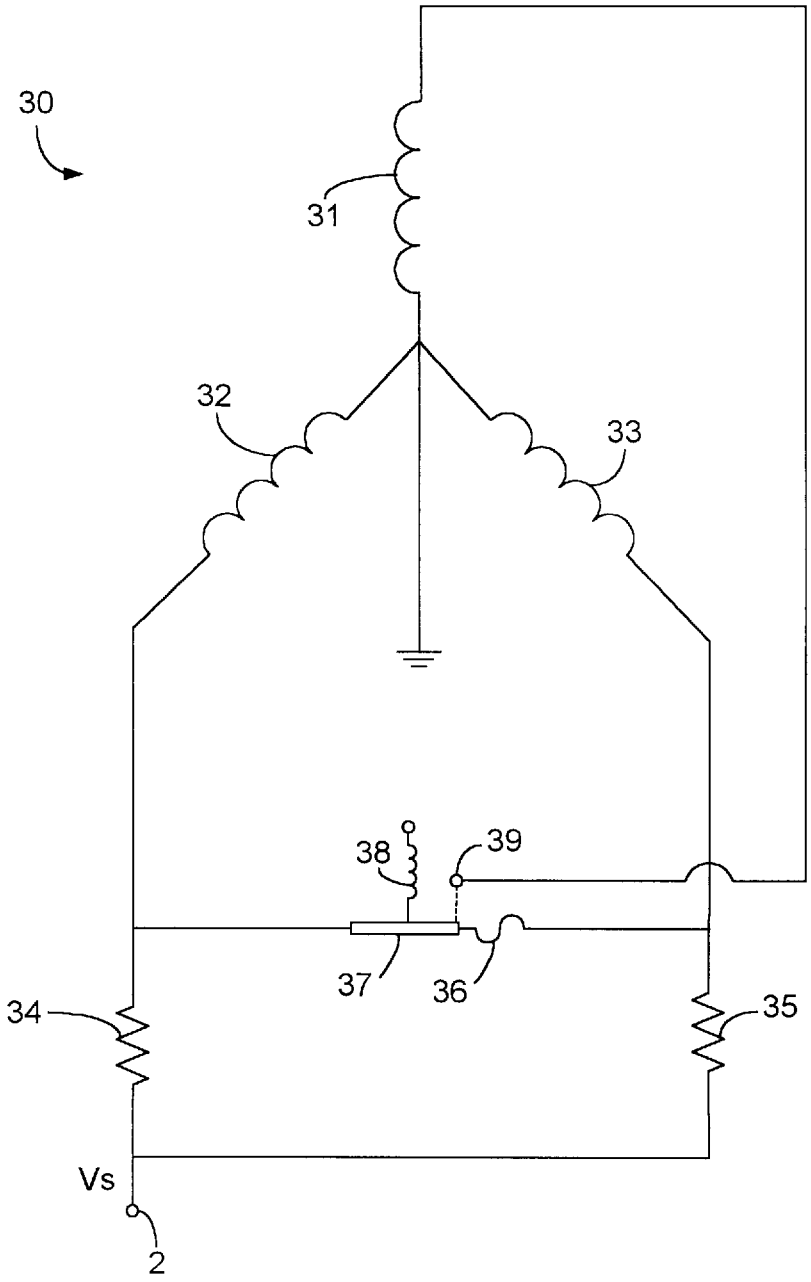
FIG. 3 is a schematic diagram of a switching circuit according to a third embodiment of the invention.
Figure 4:
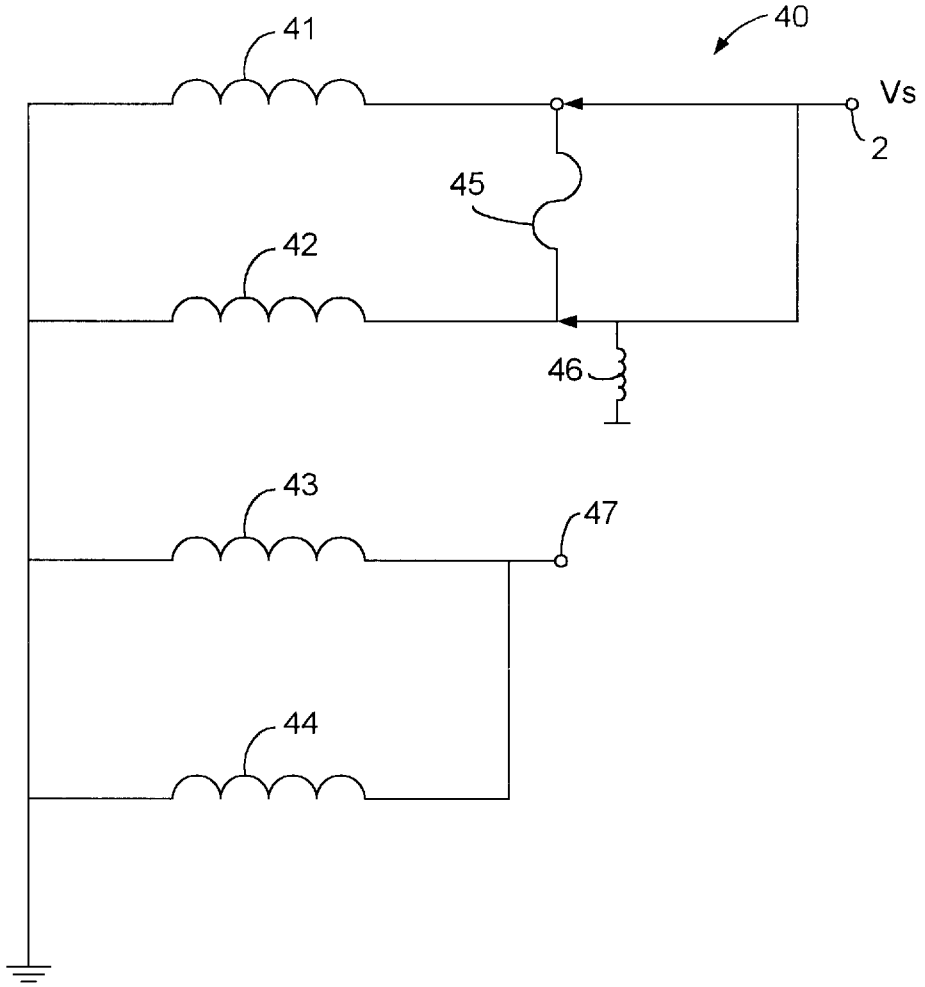
FIG. 4 is a schematic diagram of a switching circuit according to a fourth embodiment of the invention.
Figure 5:
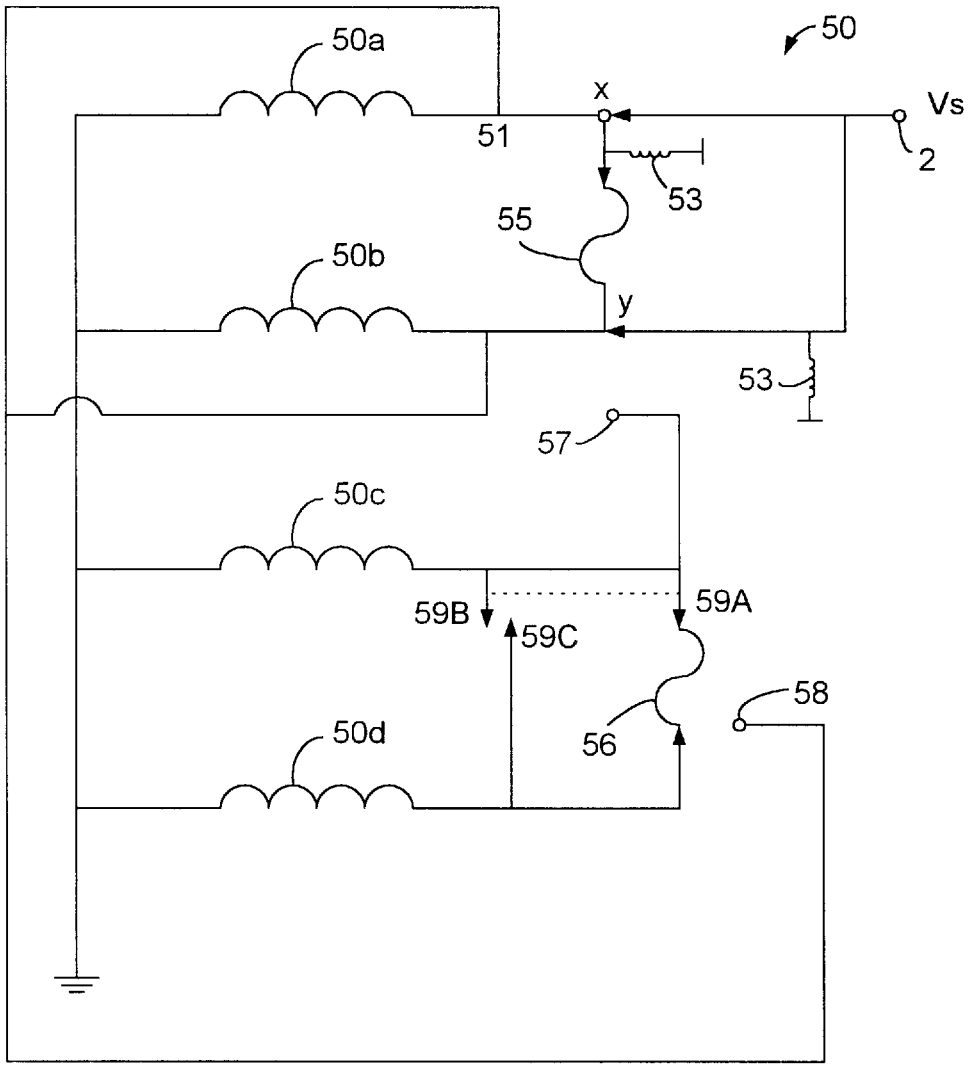
FIG. 5 is a schematic diagram of a switching circuit according to a fifth embodiment of the invention.

With reference to FIG. 3, a switching circuit 30 according to a third embodiment of the invention comprises three filaments 31, 32 and 33. A power supply terminal 2 receives a voltage source $V_s$ and equal amounts of current are supplied through optional resistors 34 and 35 and through filaments 32 and 33. When one of the filaments 32 or 33 fails, the circuit becomes unbalanced and a current is caused to flow through a fuse 36 and a conductive leaf spring 37. This current causes the fuse 36 to blow which permits the leaf spring 37 to travel toward a contact 39 with the assistance of a coil spring 38, thereby resulting in electrical contact between the leaf spring 37 and the terminal 39. As a result, a current is permitted to travel through the leaf spring 37 and then through the back-up filament 31. Preferably, the filament 31 has a brightness which equals that of filaments 32 or 33.

A switching circuit 40 according to a fourth embodiment of the invention comprises four filaments 41, 42, 43 and 44. Initially, a voltage source $V_s$ is connected to a power supply terminal 2 and current flows through filaments 41 and 42. After one of the filaments 41 or 42 blows, a current surge through a fusible link 45 opens the link 45 and permits the voltage source $V_s$ to be pulled downward by a coil spring 46 to make contact with a terminal 47. With the voltage source $V_s$ being supplied through terminal 2 to the terminal 47, the second pair of filaments 43 and 44 receive an operating current and thus function as a back-up pair of filaments.

A switching circuit 50 according to a fifth embodiment of the invention comprises four filaments 50*a*, 50*b*, 50*c*, and 50*d*. Initially, a voltage source $V_s$ is connected to a power supply terminal 2 and a current flows through the first pair of filaments 50*a* and 50*b*. When one of those filaments 50*a* or 50*b* fails, a surge of current is sent through the fusible link 55 allowing the spring 53 loaded contacts x and y to move to close contact with terminal 57. After the current surge, the voltage source $V_s$ is disconnected from the filaments 50*a* and 50*b* and is applied only to the contact terminal 57. At this time, current flows through the backup pair of filaments 50*c* and 50*d*. When one of the filaments 50*c* or 50*d* in the backup pair fails, a current surge blows a fusible link 56 and permits the spring 53 to pull the contact 59A to close the circuit at terminal 58. After the contact 59A is touching contact terminal 58 the voltage source $V_s$ is routed back to the first pair of filaments 50*a* and 50*b*. In addition the voltage source $V_s$ is allowed to remain in contact with filaments 50*c* and 50*d* via a ganged terminal 59B and 59C.

Figure 6:
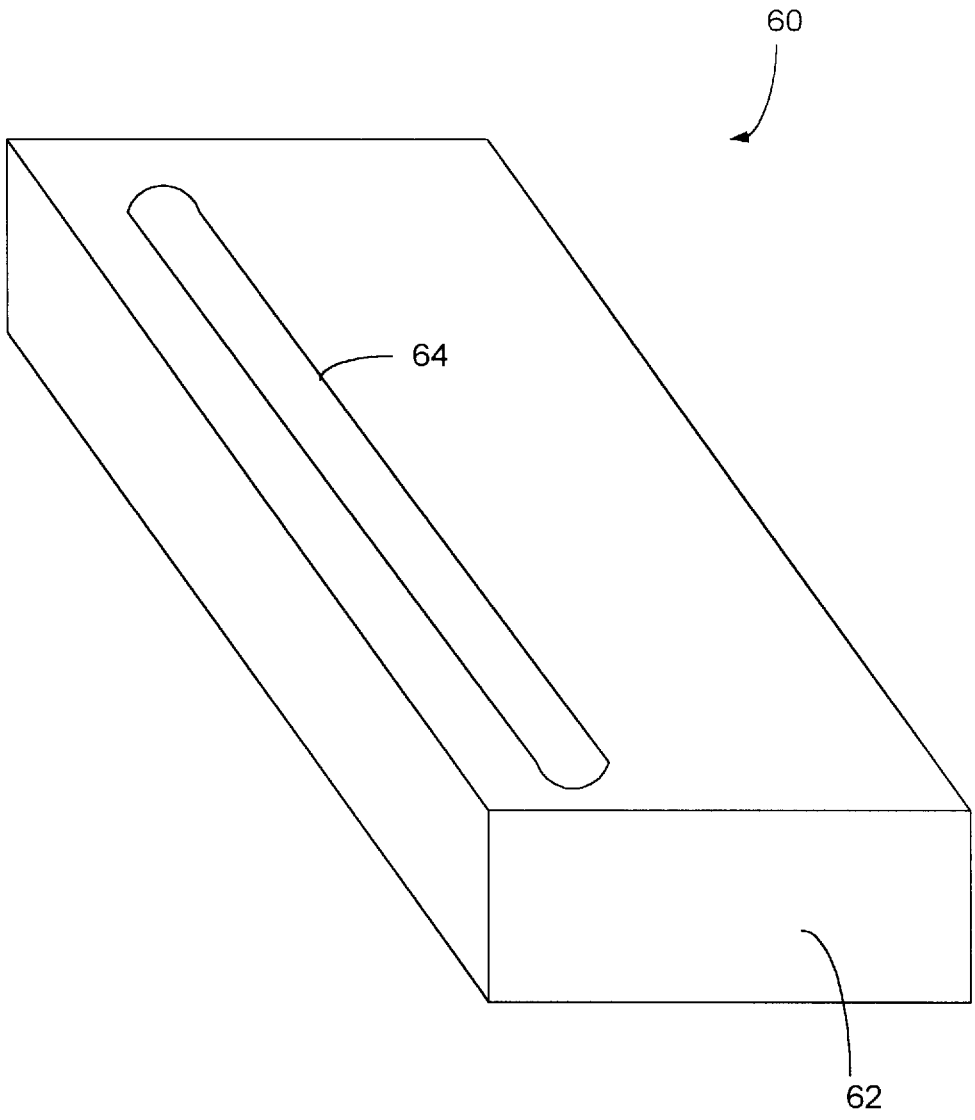
FIG. 6 is a diagrammatic view of a first portion of a switching circuit according to a sixth embodiment of the invention.
Figure 7:
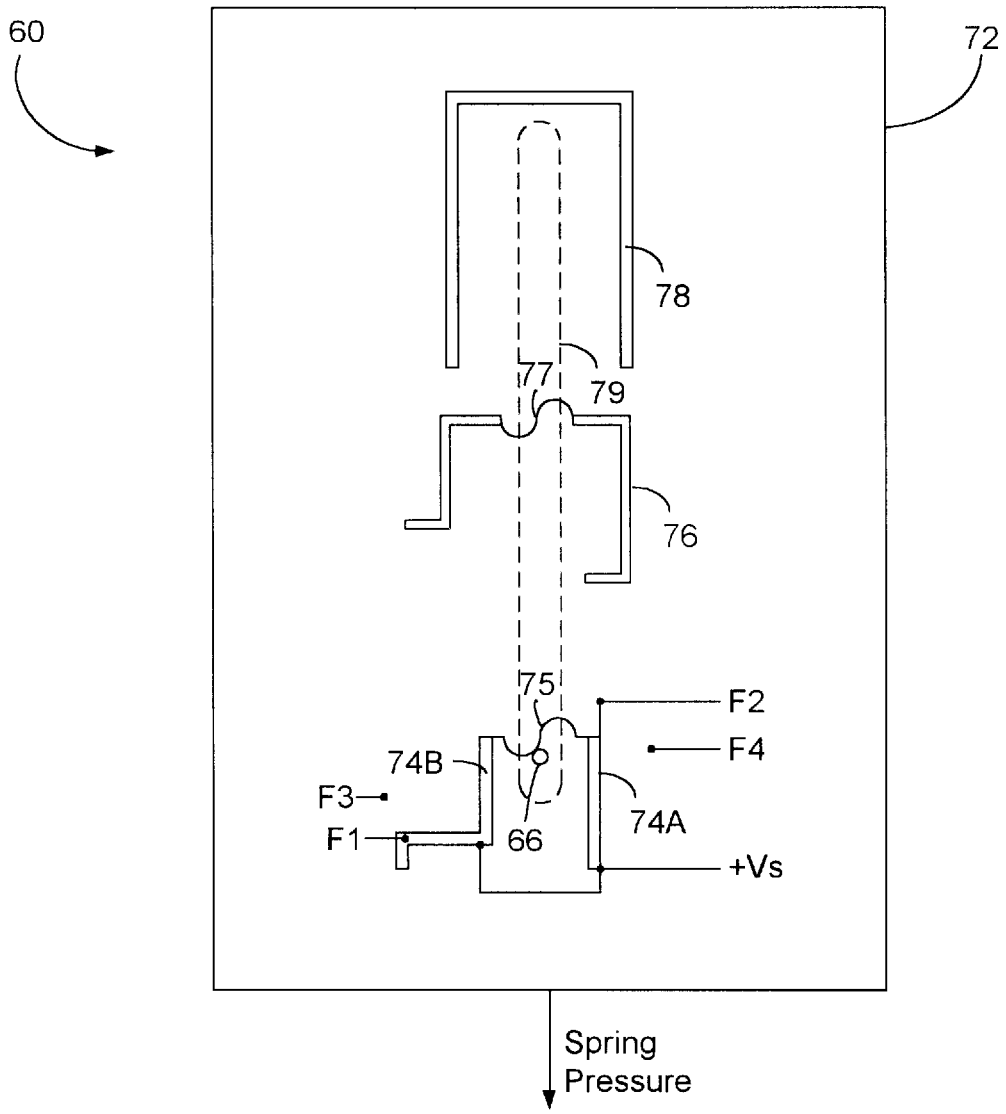
FIG. 7 is a diagrammatic view of a second portion of a switching circuit according to the sixth embodiment of the invention.

With reference to FIGS. 6 and 7, a sixth embodiment of the invention comprises a base portion 62 having a ground strip 64 extending across the length of the base portion 62. As shown in FIG. 7, a second portion 72 of the switching circuit 60 comprises three contact elements 74, 76, and 78. The viewing angle in FIG. 7 is from the top and includes the peg 66 to indicate the position of the contact elements 74, 76 and 78 relative to the bottom portion 62.

Initially, the peg 66 is in intimate contact with a fusible link 75. A voltage source $V_s$ is connected to the contact elements 74A and 74B and current is permitted to flow across the fusible link 75 and provide power to a first pair of filaments F1 and F2. The first pair of filaments F1 and F2 has a second terminal connected to the ground strip 64 whereby current is permitted to flow through the filaments F1 and F2.

When either filament F1 or F2 becomes burned out, the fusible link 75 becomes broken by a current surge and a spring pressure moves the portion 72 in a downward direction, as shown by the arrow in FIG. 7. The portion 72 of the switching circuit will travel in a downward direction until the peg 66 encounters a second fusible link 77. At this position, the voltage source $V_s$ is connected to the contact elements 76A and 76B, whereby current is permitted to flow through the second pair of filaments F3 and F4 to ground. When either filament F3 or F4 is blown, a current surge flows through the fusible link 77 and breaks the link, whereby the peg 66 is repositioned at its final position at the top of the contact element 78. In this final position, the voltage source $V_s$ is supplied to all filaments F1, F2, F3, and F4.

Thus, the switching circuit first provides power to the first pair of filaments F1 and F2 until the fusible link 75 is broken. At this time, the portion 72 moves such that contact is now made between the voltage source $V_s$ and the contact element 76A and 76B so that a second pair of filaments F3 and F4 is illuminated. When one of the second pair of filaments F3 and F4 is broken, a current surge breaks the fusible link 77 thereby causing contact to be made with the contact element 78. At this final position, the voltage source $V_s$ is supplied to all four filaments F1, F2, F3, and F4.

It should be understood that the switching circuit 60 may be fabricated in any suitable manner. For instance, in the preferred embodiment, the contacts for the filaments F1, F2, F3 and F4 and for the voltage source $V_s$ remain fixed relative to the bottom portion 62 of the switching circuit 60. The moveable portion 72 of the switching circuit 60 may be connected to any suitable type of spring pressure, such as a coil spring, for moving the portion 72 along with the contact elements 74, 76 and 78, in a certain direction. Alternatively, the contacts for the filaments F1, F2, F3 and F4 and for the voltage source $V_s$ could be moveable and the contact elements 74, 76 and 78 may remain fixed relative to the bottom portion 62.

Figure 8:
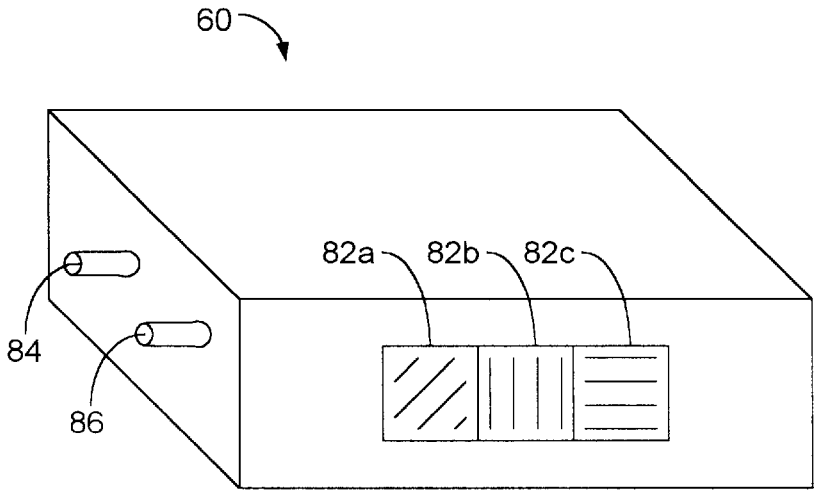
FIG. 8 is a perspective view of a housing for the switching circuit according to the sixth embodiment of the invention.

With reference to FIG. 8, the switching circuit 60 may have a viewing window 82 on one side and a pair of power terminals 84 and 86 at another end. The purposes of the viewing window 82 is to show the different states of the switching circuit 60 since it might not be apparent from the amount of illumination provided by the filaments F1, F2, F3 and F4. As the moveable portion 72 is slid due to the spring pressure, the viewing window 82 will reveal the position of the moveable portion 72. In a first position, a viewing window 82*a* may be revealed having a first color, such as green, and will indicate a state in which the peg 66 is in contact with the fusible link 75. In a second-state, a second viewing window 82*b* may be revealed which has a second color, such as yellow, which indicates that the peg 66 is in intimate contact with the fusible link 77. The third and final position of the peg 66, which is when the peg 66 is in contact with the contact element 78, would then correspond to the viewing of a third window portion 82*c*, which may have a red color. Consequently, the switching circuit 60 may show a green window area 82*a* when all filaments are still in a good state, a yellow window portion 82*b* when the one filament has blown, and a red window portion 82*c* when two filaments have blown, leaving only one pair of filaments from the combination of F1, F2, F3, and F4.

Figure 9:
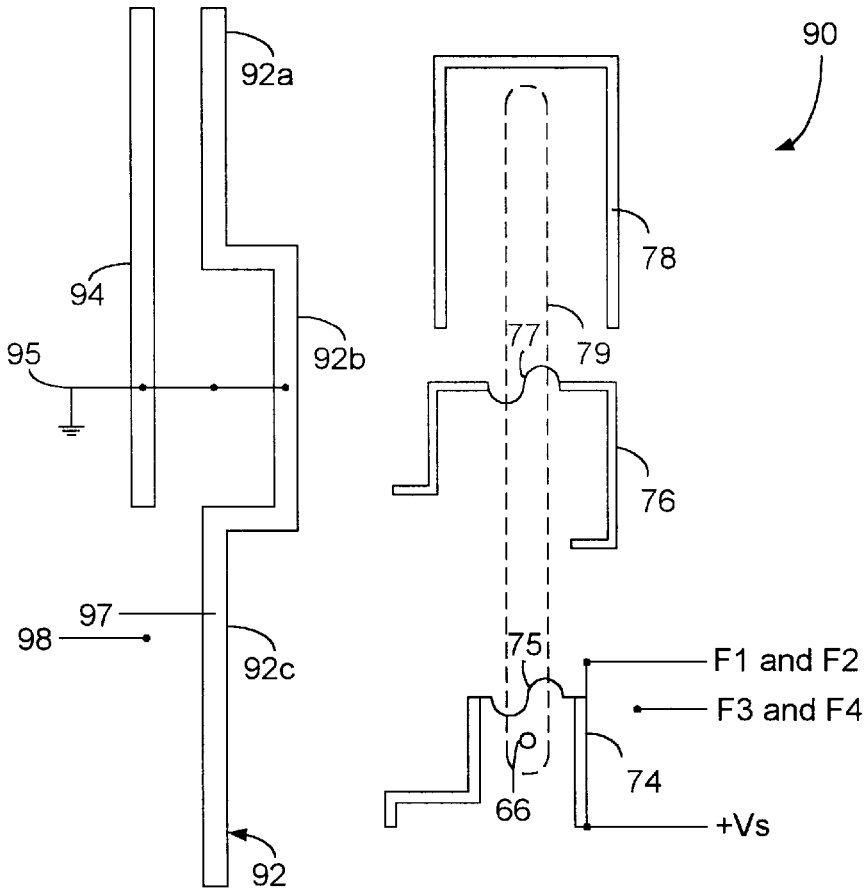
FIG. 9 is a schematic diagram of a switching circuit according to a seventh embodiment of the invention.

A switching circuit 90 according to another embodiment of the invention, is similar to switching circuit 60 in that it has a peg 66 moveable within a groove to contact a first contact element 74, a second contact element 76, then a third contact element 78. The switching circuit 90 differs from switching circuit 60 in that the ground contacts are also switched into and out of contact with the filaments. In the example shown in FIG. 9, the ground contact 97 for filaments F1 and F2 is connected to a grounding strip 92 when the peg 66 is in contact with fusible link 75. Thus, current is permitted to flow from contact element 74 and through the first and second filaments F1 and F2. After one of the filaments F1 or F2 becomes burned out, the fusible link 75 breaks, thereby allowing the peg 66 to come into contact with the fusible link 77. In this position, the contact element 76 makes electrical contact between the voltage source $V_s$ and the third and fourth filaments F3 and F4 thereby permitting current to flow through these filaments. Also, at this position, a ground strip 94 is lowered into contact with a ground terminal 98 for the third and fourth filaments F3 and F4. Consequently, current is permitted to flow from the voltage source $V_s$ through the third and fourth filaments F3 and F4. On the other hand, the ground terminal 97 for filaments F1 and F2 is positioned between ground contacts 92 and 94 and does not touch either of the contacts 92 and 94. Likewise, the contact element 76 does not make contact with the contact for filaments F1 and F2 whereby power is not supplied to these filaments.

After one of the filaments F3 or F4 becomes blown, the contact element 78 is moved down into position with the peg 66. The contact element 78 connects the voltage source $V_s$ to both the first and second filaments F1 and F2 and also to the third and fourth filaments F3 and F4. The ground terminals for the first and second filaments F1 and F2 and also the ground terminal 98 for the third and fourth filaments F3 and F4 are connected to the ground contacts 92 and 94, respectively. Therefore, since all filaments are connected to the voltage source $V_s$ and to ground, all of the remaining good filaments can conduct current and provide illumination.

The switching circuit 90 is preferred over the switching circuit 60 in the sense that the ground terminals 97 and 98 are disconnected from ground when the filaments are burned out. As a result, a broken half of the filament is floating electrically and will not cause fluctuations in level of illumination in the lamp.

The switching circuits according to the invention are not limited to just the switching of back-up filaments in a light bulb or lamp. Rather, the invention may be applied to various other types of electrical loads. For instance, a switching circuit according to the invention would advantageously be used in motors or compressors to switch in back-up windings. In the specific application of the invention to a compressor winding, a refrigeration or freezer unit within a commercial food store would automatically switch to a back-up winding when the primary winding fails. Whereas the food store would normally incur a large expense in wasted food items as well as service charges in having the compressor replaced, the food store would save substantial sums of money by having this back-up winding automatically switched into circuit when the primary winding fails.

Additionally, in FIGS. 3 to 5, 7 and 9, if one filament in each parallel circuit was replaced by a resistor of the correct impedance, or other type of load, the circuit would still be workable.

Other applications and variations to the circuits as will be apparent to those skilled in the art are included within the spirit and scope of the invention.

I claim:

1. An electric circuit comprising:

a first filament having a first and second end, the first end being electrically connected to ground;

a second filament having a first and second end, the first end being electrically connected to ground;

a third filament having a first and second end, the first end being electrically connected to ground;

a fusible link electrically connecting the second end of the first filament and the second end of the second filament;

a first electrical contact for connection to a voltage source, the electrical contact being electrically coupled to the second end of the first filament, the electrical contact also being electrically coupled to the second end of the second filament;

a second electrical contact electrically connected in series and mechanically attached to the fusible link; and a mechanical spring disposed to urge the second electrical contact toward a terminal contact that is electrically connected to the second end of the third filament;

whereby current flow between the first and second filaments and not in the third filament and the electrical contact maintains a series connection with the fusible link so long as the first and second filaments remain intact, the mechanical spring disposed to establish an electrical connection between the second electrical contact and the terminal contact when either the first or second filament ruptures to an open circuit causing current to flow through the third filament.

2. The circuit as defined in claim 1, further including a pair of balanced resistors including a first resistor electrically connected between the first electrical contact and the second end of the first filament and a second resistor electrically connected between the first electrical contact and the second end of the second filament.

* * * * *